US007559534B2

(12) United States Patent
Giacomini et al.

(10) Patent No.: US 7,559,534 B2
(45) **Date of Patent: *Jul. 14, 2009**

(54) INTEGRATED AIR COMPRESSOR AND WINCH

(75) Inventors: Thomas W. Giacomini, Portland, OR (US); Bryan M. Averill, Portland, OR (US); Richard J. Geisler, Oregon City, OR (US); Steven W. Shuyler, Clackamas, OR (US); Oliver Heravi, Tigard, OR (US)

(73) Assignee: Warn Industries, Inc., Milwaukie, OR (US)

( * ) Notice: Subject to any disclaimer, the term of this patent is extended or adjusted under 35 U.S.C. 154(b) by 124 days.

This patent is subject to a terminal disclaimer.

(21) Appl. No.: 11/756,822

(22) Filed: Jun. 1, 2007

(65) Prior Publication Data

US 2007/0221898 A1 Sep. 27, 2007

Related U.S. Application Data

(63) Continuation-in-part of application No. 11/149,492, filed on Jun. 9, 2005, now Pat. No. 7,311,298.

(60) Provisional application No. 60/825,327, filed on Sep. 12, 2006.

(51) Int. Cl.
*B66D 1/00* (2006.01)

(52) U.S. Cl. ..... 254/323; 254/361

(58) Field of Classification Search ..... 254/323, 254/361, 328

See application file for complete search history.

(56) References Cited

U.S. PATENT DOCUMENTS 3,986,588 A 10/1976 Kuzarov
4,004,780 A 1/1977 Kuzarov
4,033,552 A 7/1977 Kuzarov
4,047,311 A 9/1977 Kelley
4,162,713 A 7/1979 Heitman et al.
4,185,520 A 1/1980 Henneman et al.
4,441,690 A 4/1984 Koopmans et al.
4,444,273 A 4/1984 Ruby
4,448,398 A 5/1984 Wyatt
4,461,460 A 7/1984 Telford
4,482,133 A 11/1984 Bishop
4,545,567 A 10/1985 Telford et al.
4,736,929 A 4/1988 McMorris
4,746,100 A 5/1988 Davenport et al.
5,261,646 A 11/1993 Telford
5,482,255 A 1/1996 Daschel et al.
5,692,735 A 12/1997 Aho et al. ..... 254/323

(Continued)

FOREIGN PATENT DOCUMENTS

GB 750967 6/1956

(Continued)

*Primary Examiner*—Emmanuel M Marcelo
(74) *Attorney, Agent, or Firm*—Harness, Dickey & Pierce, P.L.C.

(57) ABSTRACT

An integrated air compressor and winch is provided that utilizes a single source of rotary motive power for driving both a winch drum and compressor mechanism. The integrated air compressor and winch is preferably provided with a gear case that is operable to provide an appropriate gear reduction for driving the winch drum while providing an appropriate drive speed for operating the compressor.

73 Claims, 8 Drawing Sheets

U.S. PATENT DOCUMENTS

| | | | | |
|---|---|---|---|---|
| 5,720,400 | A | 2/1998 | Altizer, Sr. | |
| 5,794,920 | A | 8/1998 | Kronberger | |
| 5,842,684 | A | 12/1998 | Aho | |
| 5,997,426 | A | 12/1999 | Ito et al. | |
| 6,012,707 | A | 1/2000 | Enlund et al. | |
| 6,357,159 | B1 * | 3/2002 | Bowling | 43/2 |
| 6,371,449 | B1 | 4/2002 | Chamberlain | |
| 6,604,731 | B2 | 8/2003 | Hodge | |
| 6,658,852 | B2 | 12/2003 | Frey et al. | |
| 6,695,566 | B2 | 2/2004 | Rodriguez Navio et al. | |
| 2003/0164256 | A1 | 9/2003 | Murray et al. | |
| 2004/0134175 | A1 | 7/2004 | Osborne | |

FOREIGN PATENT DOCUMENTS

| | | | |
|---|---|---|---|
| WO | WO79/00932 | | 11/1979 |
| WO | 2004026753 | A1 | 4/2004 |

* cited by examiner

INTEGRATED AIR COMPRESSOR AND WINCH

CROSS-REFERENCE TO RELATED APPLICATIONS

This application is a continuation-in-part of U.S. patent application Ser. No. 11/149,492 filed on Jun. 9, 2005 and also claims the benefit of U.S. Provisional Application No. 60/825,327 filed on Sep. 12, 2006. The disclosures of the above applications are incorporated herein by reference.

FIELD

The present disclosure relates to an integrated air compressor and winch mechanism, and more particularly, to a drive train for transmitting power to the air compressor and winch.

BACKGROUND AND SUMMARY

Winches have been commonly mounted to a support bracket at the front bumper location of an automobile, and have been used to perform a variety of tasks, such as dragging a large object while the vehicle is stationary, or moving the vehicle itself by attaching the free end of the winch cable to a stationary object and reeling in the cable to pull the vehicle toward that object. These typical winches include a cable winding drum supported on each end and include an electric or hydraulic motor in combination with a speed reducing gear transmission for transmitting torque to the cable winding drum. The use of winches with off-road and utility vehicles has greatly enhanced the functionality of the vehicles. However, it is still desirable to further enhance the vehicle functionality, as well as the functionality of the winch.

The present disclosure provides an integrated air compressor and winch system that uses a common drive motor for driving both the winch drum and the air compressor mechanism so as to enhance the functionality of the winch as it is used on a vehicle, or as is used in other industrial applications. The present disclosure utilizes a source of rotary motive power such as an electric motor, hydraulic motor, or internal combustion engine that is used in combination with a drum mechanism selectively engageable with the source of rotary motive power having a cable adapted to be wound onto and off from the drum mechanism, and a compression mechanism selectively engageable with the source of rotary motive power. The compression mechanism is capable of generating stored compressed gasses or alternatively stored vacuum.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
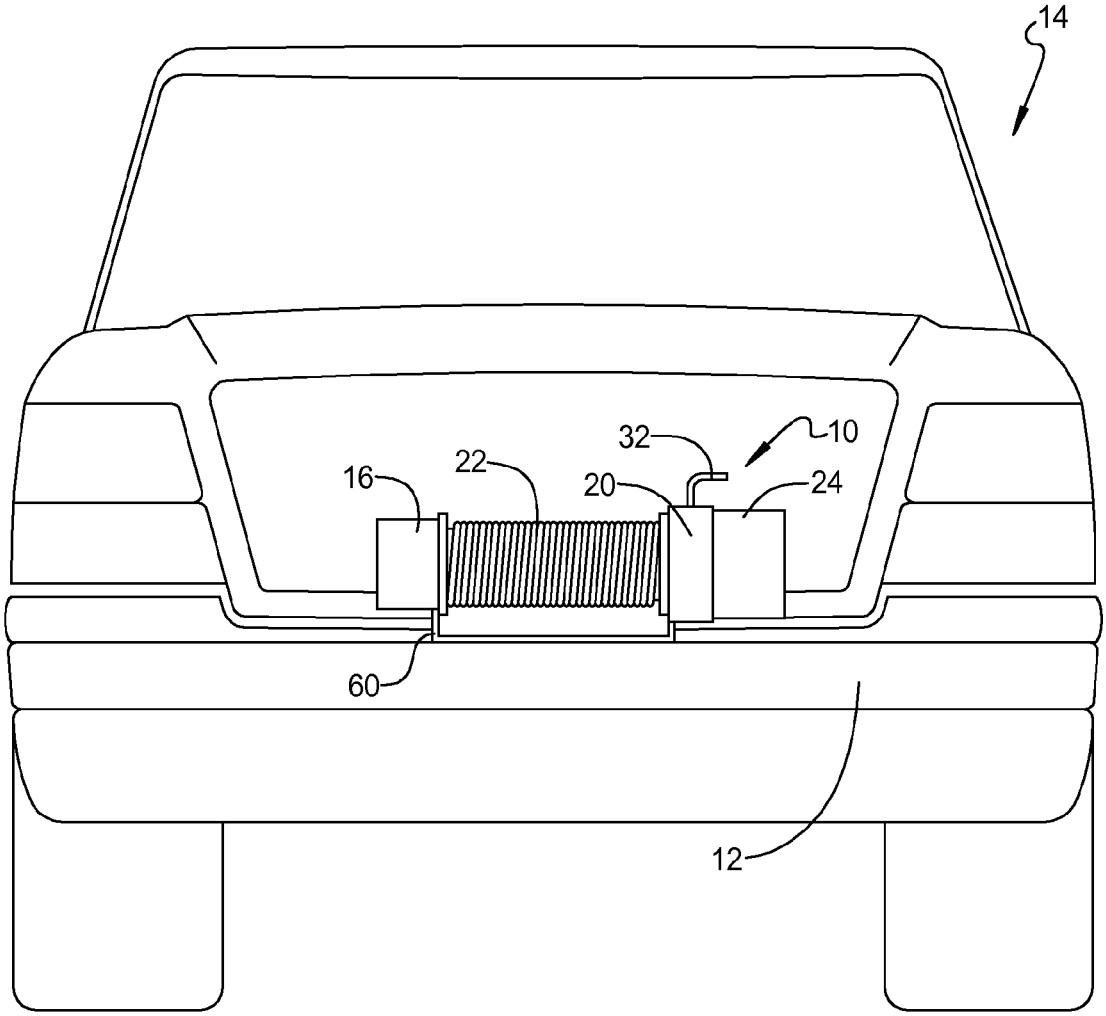
FIG. 1 illustrates an integrated air compressor and winch according to the principles of the present disclosure.

With reference to FIG. 1, the integrated air compressor and winch 10 is shown mounted to a front bumper 12 of a vehicle 14. The integrated air compressor and winch includes an electric motor 16 which has an output shaft engaged with a switchable gear case 20 that is selectively operable by shift mechanism 32 to provide driving torque to the winch drum 22 or to compressor mechanism 24.

Figure 2:
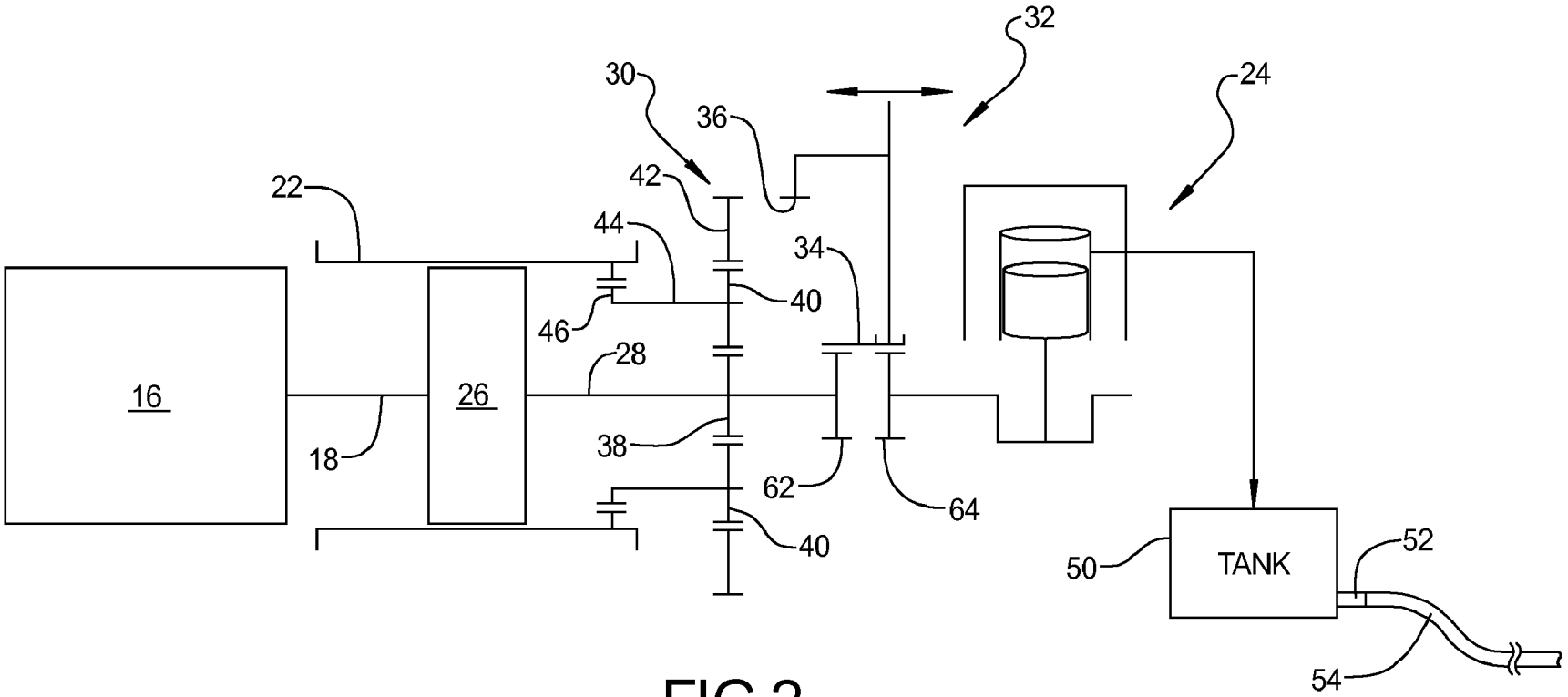
FIG. 2 is a schematic diagram of the integrated air compressor and winch mechanism according to the principles of the present disclosure.

The motor 16 serves as a source of rotary motive power and can include an electric motor, hydraulic motor, internal combustion engine, or other known sources of rotary motive power. As illustrated in FIG. 2, the motor 16 has an output shaft 18 that preferably supports a brake device 26. The brake device can be of the type shown in commonly assigned U.S. Pat. No. 4,461,460; U.S. Pat. No. 5,482,255; U.S. Pat. No. 4,545,567; or U.S. Pat. No. 5,261,646, all of which are herein incorporated by reference. In addition, other brake mechanisms known in the art could also be utilized with this system.

The gear case 20 receives drive torque from intermediate shaft 28 which is connected to the brake device 26. The gear case 20 can include a planetary reduction gear system 30 that is selectively operable by shift mechanism 32 to provide drive torque to the drum 22. The shift mechanism 32 can also be operable to engage the intermediate shaft 28 for direct engagement with the compressor mechanism 24 by movement of coupler sleeve 34. The gear reduction mechanism 30 can be of any known type of reduction gearing and can include a single planetary gear system as shown or a multiple planetary gear system as shown in commonly assigned U.S. Pat. Nos. 4,545,567; 4,461,460; 4,736,929; 5,261,646, which are all herein incorporated by reference. The planetary gear mechanism 30, as shown, is provided with a sun gear 38 fixed for rotation with intermediate shaft 28. A plurality of planetary gears 40 are in meshing engagement with the sun gear 38 and with an annular ring gear 42. The planetary gears 40 are supported by a planetary carrier 44 which is provided with a splined connection to the drum 22 at 46. The clutch mechanism 36 is engageable with the annular ring gear 42 to prevent rotation thereof in order to cause rotation of the planet carrier 44 when the sun gear 38 is rotated. When the annular ring gear 42 is not engaged by the shift mechanism 32, the ring gear 42 is free to rotate along with rotation of the sun gear 38 and planet gears 40 so that no appreciable torque is applied to the planet carrier 44 and thus, no rotation is imparted to the drum 22. The shift mechanism 32 is designed to allow torque to be applied either to the drum 22 or compressor 24 depending upon the position of the shift mechanism 32. For driving the compressor 24, the shift mechanism 32 moves coupler 34 into simultaneous engagement with splined member 62 (connected to intermediate shaft 28) and splined member 64 (connected to compressor 24).

The compressor mechanism 24 can be of any known compressor type, including piston, rotary vane, and scroll-type compressors, as well as other known compressors. The compressor 24 includes a storage tank or vessel 50 that receives compressed air or vacuum from the compression mechanism and stores the compressed air or vacuum for subsequent use. The storage tank 50 includes a compressor hose fitting 52 which is releasably engageable with a compressor hose 54. Furthermore, the compressor 24 includes a pressure regulator and other valving and controls typically associated with compressors.

The integrated air compressor and winch is mounted on a common support 60 which can be mounted to a vehicle or used in other industrial applications. In the embodiment shown, the motor 16 is disposed on one side of the drum 22 while the gear case 20 and compressor 24 are mounted on the opposite side of the drum 22. It should be understood that other variations of this arrangement could also be utilized in which the motor 16, gear case 20, and compressor 24 can all be mounted on the same side, or wherein the motor and gear case can be mounted on one side with the compressor on the other, or with the motor and compressor on one side with the gear case on the other. Furthermore, other configurations with the motor and/or compressor being non-coaxially mounted with the drum can also be utilized.

Figure 3:
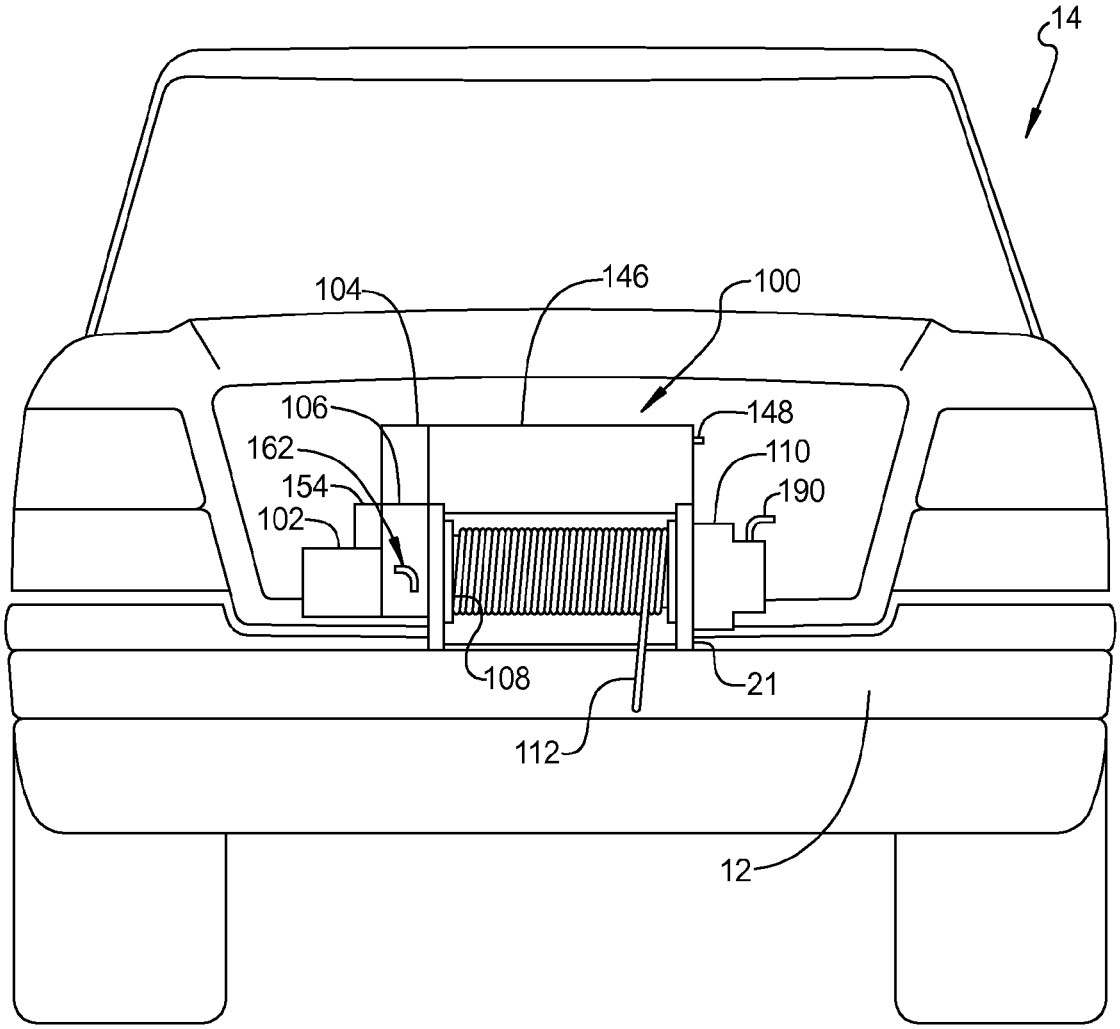
FIG. 3 illustrates a second exemplary integrated air compressor and winch according to the principles of the present disclosure.
Figure 4:
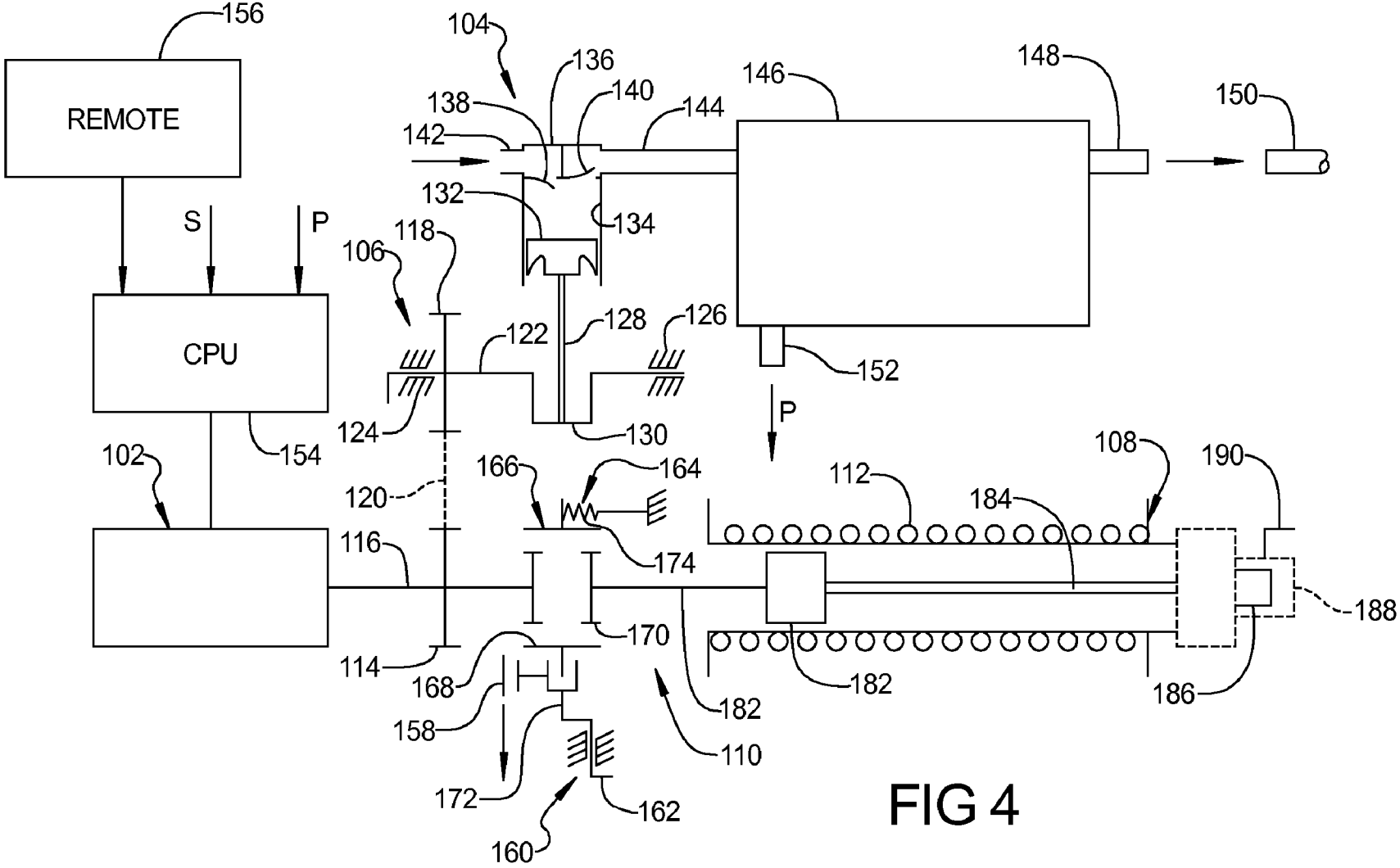
FIG. 4 is a schematic diagram of the second exemplary integrated air compressor and winch according to the principles of the present disclosure.
Figure 5:
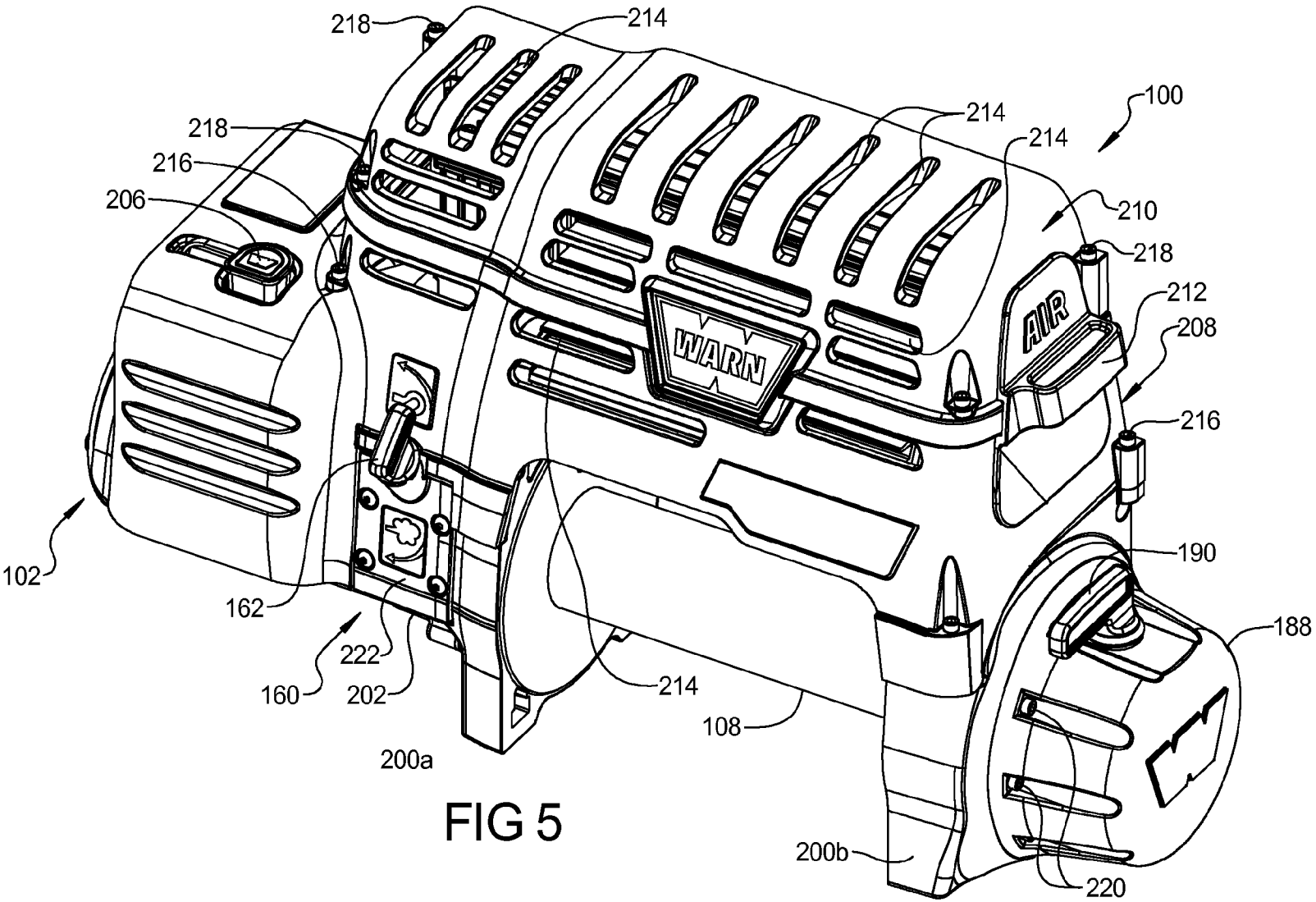
FIG. 5 is a front perspective view of the exemplary integrated air compressor and winch shown in FIG. 3.

With reference to FIGS. 3-7 an integrated air compressor and winch mechanism according to a second exemplary embodiment will now be described. As best seen in FIGS. 3-5, the integrated air compressor and winch 100 includes an electric motor 102 which is connected to a compression mechanism 104 by a first drive train 106. The integrated air compressor and winch 100 also includes a drum 108 connected to the electric motor 102 by a second drive train 110. The drum 108 receives a cable 112 that is capable of being wound on to and wound off from the drum 108 when the drum 108 is rotated.

The first drive train 106 includes a drive pulley 114 connected to the output shaft 116 of electric motor 102. An offset driven pulley 118 is connected to the drive pulley 114 by a drive belt 120. The drive pulley 114 and driven pulley 118 provide a drive ratio reduction relative to the electric motor output shaft 116. The driven pulley 118 is connected to a crank shaft 122 rotatably supported at opposite ends by bearing assemblies 124, 126 supported by a gear case 202 (described in greater detail herein). A connecting rod 128 is connected to an eccentric portion 130 of crank shaft 122 and is connected to a piston 132 which is disposed within a cylinder 134. A cylinder head 136 is mounted to the cylinder 134 and supports an intake read valve 138 and an outlet read valve 140 therein. An air intake fitting 142 is provided in communication with the intake read valve 138. An outlet passage 144 is provided in communication with the outlet read valve 140 and communicates with an intercooler storage vessel 146. The intercooler storage vessel 146 can be provided with cooling fins to facilitate cooling of the compressed air received therein. An outlet fitting 148 is connected to the intercooler storage vessel 146 and is adapted to be releasably connected to a hose 150. A pressure sensor 152 is provided for providing a pressure signal P to the central processing unit 154 which controls operation of the electric motor 102.

The central processing unit 154 is provided in communication with the electric motor 102 to operate the motor. The central processing unit 154 is connected to a remote control unit 156 which can be utilized by an operator for operating the winch and/or compressor. The central processing unit 154 receives a switch signal S from a mode detection switch 158 that is indicative of the operating mode of the integrated compressor and winch 100. In particular, the integrated compressor and winch 100 includes a mode selector 160 including a lever 162 operable by a user for engaging a clutch mechanism 164 for connecting the second drive train 110 to the first drive train 106. The clutch mechanism 164 includes an internally splined clutch ring 166 that is slideable between engaged and disengaged positions for providing drive torque from an externally spline drive member 168 connected to the electric motor output shaft 116. The drive member 168 can be selectively coupled to an externally splined driven member 170 by the clutch ring 166 being in driving engagement with the drive member 168 and driven member 170.

The selector mechanism 160 is provided with an eccentric portion 172 which engages a shift fork 173 connected to the clutch ring 166 to cause axial movement of the clutch ring 166 between the engaged and disengaged positions. A biasing spring 174 is provided for biasing the clutch ring 166 from a disengaged position towards an engaged position. Alternatively, it should be understood that the biasing spring 174 could be configured to bias the clutch ring 166 from the engaged position from a disengaged position. The mode switch 158 is operably connected to the mode selector 160 and/or clutch ring 166 so as to be moved between a closed and opened position when the mode selector 160 is operated, thus providing an appropriate signal to the central processing unit 154 to indicate when the integrated air compressor and winch 100 is switched between a winching mode and a compressor mode.

The second drive train 110 includes a shaft 180 connected to the driven member 170 and connected to a brake mechanism 182 disposed within the drum 108. The brake mechanism 182 is connected to an output shaft 184 that extends through the center of the drum 108 and engages a planetary gear assembly 186 contained within gear housing 188. The planetary gear assembly 186 is selectively engagable with the drum 108. A shift lever 190 is provided for shifting the planetary gear assembly between a drive and neutral positions. It should be understood that the brake mechanism 182 and planetary gear assembly 186 are generally known in the art as shown in commonly assigned U.S. Pat. Nos. 5,482,255; 5,261,646 and 4,461,460 each of which is herein incorporated by reference in their entirety.

Figure 6:
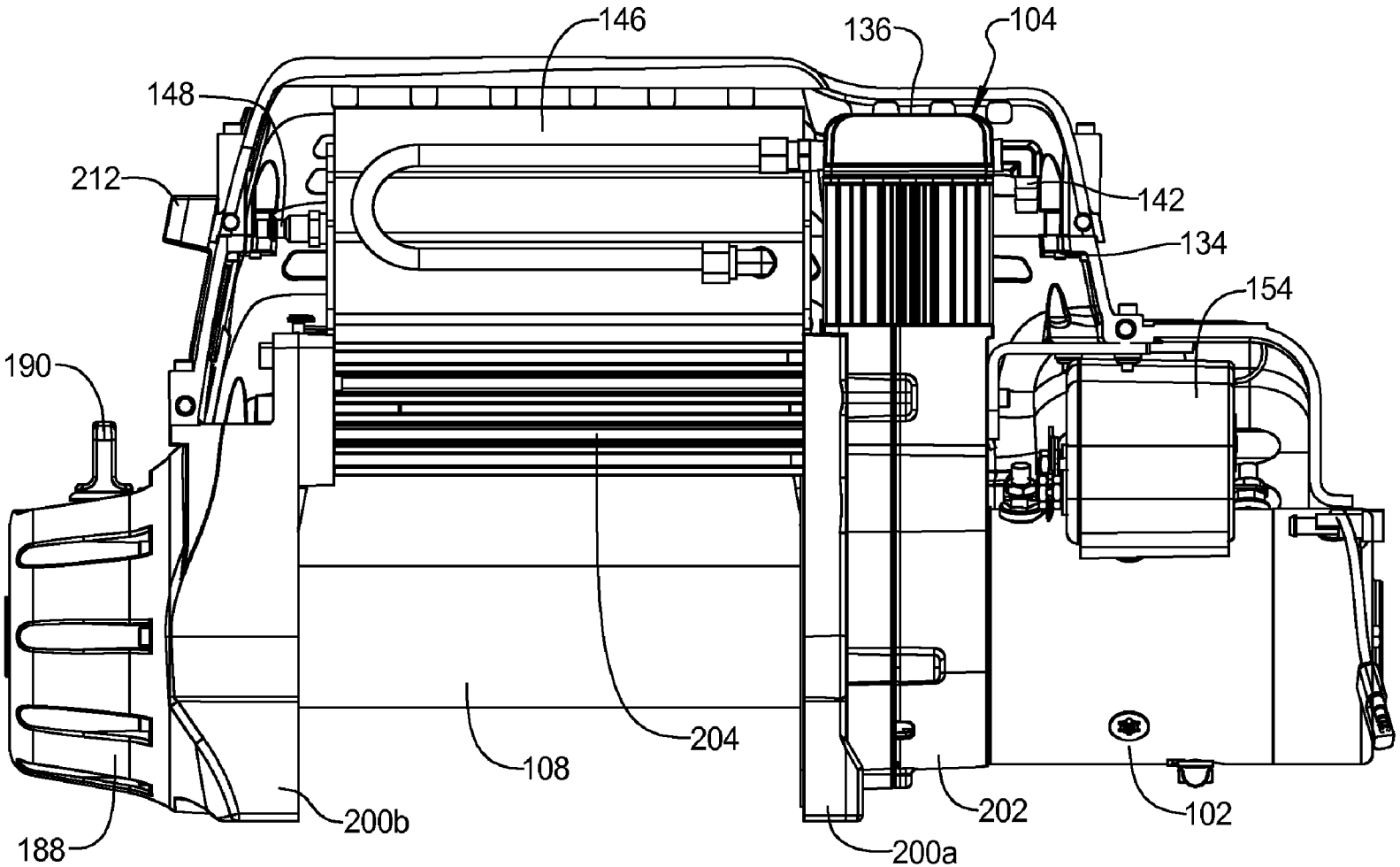
FIG. 6 is a rear plan view of the exemplary integrated air compressor and winch shown in FIG. 3.

With reference to FIGS. 5 and 6, the drum 108 is supported at opposite ends by first and second end support brackets 200*a*, 200*b*. The winch gear case 188 is shown connected to the support bracket 200*b* and motor 102 is connected to the support bracket 200*a* by a gear case 202 that houses the first drive train 106 and clutch mechanism 164. The cylinder 134 of the compression mechanism 104 is mounted to the gear case 202, as best shown in FIG. 6. The intercooler storage vessel 146 defines a bridge structure interposed between and connecting first and second support brackets 200*a*, 200*b*.

The central processor unit 154 is mounted above the motor 102 and is provided with an access cap 206, best shown in FIG. 5, which when removed, allows connection of the remote control unit 156 to the central processing unit 154. As shown in FIG. 5, the integrated air compressor and winch 100 includes a front cover portion 208 that covers portions of the support brackets 200*a*, 200*b*, intercooler storage vessel 146, gear case 202, electric motor 102, as well as the central processing unit 154. An upper cover 210 is mounted to the front cover 208 and covers the compressor 104 and intercooler storage vessel 146. An access door 212 is capable of being opened to allow access to the outlet fitting 148 provided on the intercooler storage vessel 146. The front cover 208 and upper cover 210 are each provided with air passages 214 therein to allow cooling of the compressor 104 and intercooler storage vessel 146. The front cover 208 and upper cover 210 also prevent an operator from inadvertently touching the hot components of the integrated air compressor and winch 100. The front cover 208 is secured to the support brackets 200*a*, 200*b* by fasteners 216 and the upper cover 210 is mounted to the front cover 208 by fasteners 218. The gear case housing 188 is mounted to the support bracket 200*b* by fasteners 220. The mode selector mechanism 160 includes a face plate 222 that is mounted to the gear case 202. The front cover 208, upper cover 210, face plate 222, gear case 202 and gear housing 188 define a common housing for the integrated air compressor and winch components.

Figure 7:
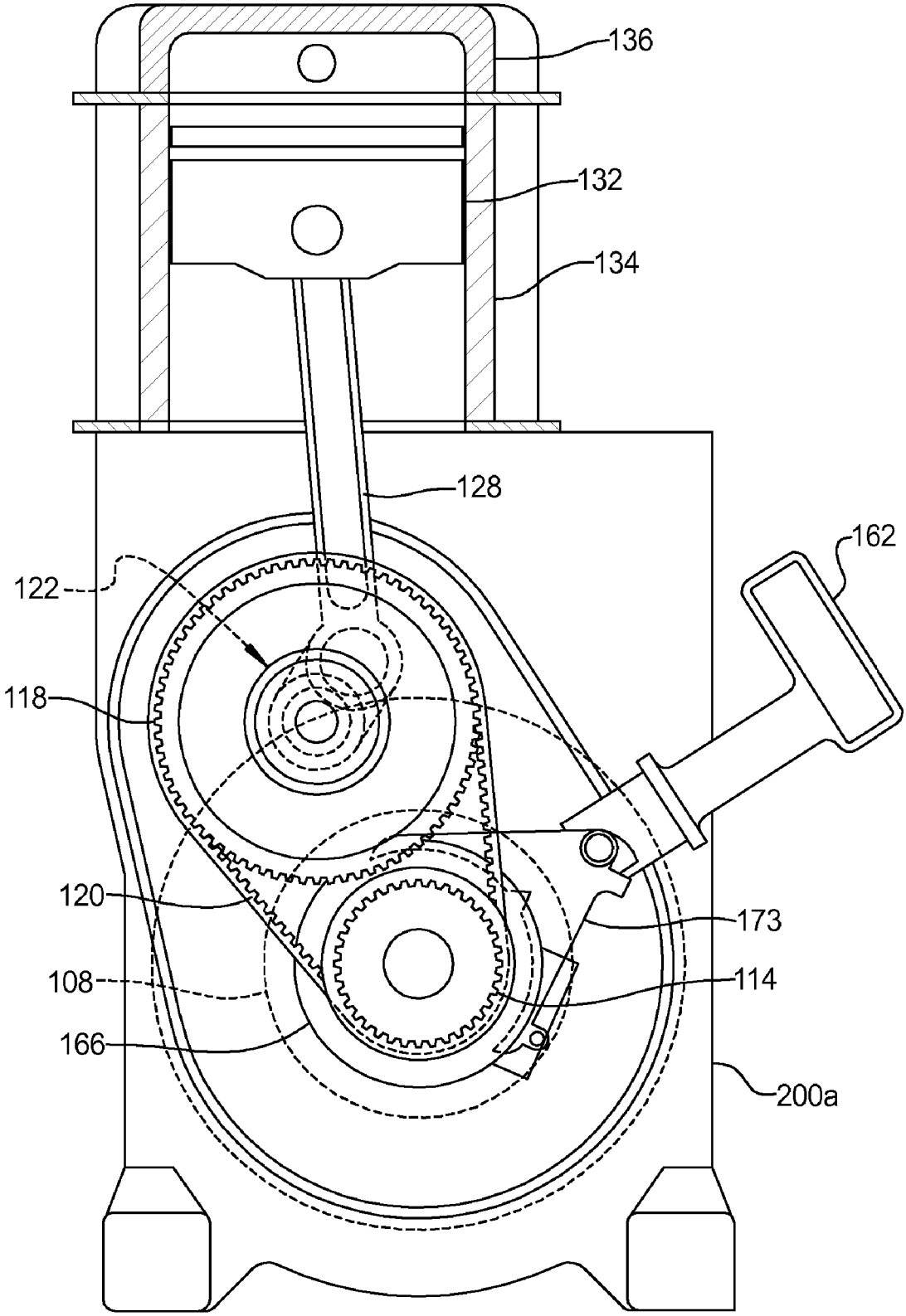
FIG. 7 is a side view of the compressor and crankcase and mode selector of the integrated air compressor and winch of FIG. 3 with the motor and crank case housing removed.

With reference to FIG. 7, the mode selector mechanism 160 is shown with the mode selector lever 162 in the compressor mode position. In this position, the clutch ring 166 is moved to a disengaged position against the biasing force of spring 174. The eccentric portion 172 at the end of the mode selector lever 162 engages the shift fork 173 which is moveable to slide the clutch ring 166 between the engaged and disengaged positions.

In operation, an operator can select between the compressor mode and the winching mode by actuation of the mode selector lever 162. Mode selector lever 162 can be actuated for sliding the clutch sleeve 166 between engaged and disengaged positions. In the engaged position, the winch mode is selected, while in the disengaged position the compressor mode is selected. When the clutch ring 166 is in the engaged position, the selector switch 158 is closed and therefore provides an appropriate signals to the central processing unit 154 to indicate to the central processing unit 154 that the winching mode has been selected. In the disengaged position of the clutch ring 166, the selector switch 158 is open thus providing an appropriate signals to the central processing unit 154 that the compressor mode has been selected. It should be understood that the open and closed positions of the selector switch 158 can be reversed so as to correspond alternatively to the engaged and disengaged positions.

During operation in the compressor mode, the electric motor 102 can be operated to drive the drive pulley 114 which in turn drives the driven pulley 118 which drives the crank shaft 122. The crankshaft is rotatably supported by bearing assemblies 124, 126 which are supported by the gear case 202. The piston 132 is caused to reciprocate within cylinder 134 as air is drawn inward through intake 142 and inlet read valve 138 and compressed air is caused to pass through outlet read valve 140 into intercooler storage vessel 146. A pressure sensor 152 is provided on the intercooler storage vessel 146 for sensing a pressure therein and providing a signal to the central processing unit 154. The central processing unit 154 continues to monitor the pressure as detected by the pressure sensor 152 so as to continue to operate the compressor when the pressure falls below a predetermined lower limit level, such as 80 psi, and will operate the compressor until the pressure reaches a second predetermined upper limit level such as 100 psi. A hose 150 is connected to the outlet 148 of the intercooler storage vessel 146 and can be connected to an end user of the compressed air.

When the integrated air compressor and winch 100 is in the winching mode, the clutch ring 166 is moved to the engaged position by the mode selector 160 and the mode switch 158 is closed to provide a signal to the central processing unit 154 to indicate that the unit 100 is in the winching mode. The remote control 156 can then be operated by a user to control the rotational direction of electric motor 102 to control the direction of rotation of drum 108. The selector lever 190 of the winch gear case 188 allows the planetary gear train to be engaged and disengaged for drive and neutral positions. In the neutral position, the spool 108 is released to allow the cable 112 to be manually unwound by the user. In the embodiment shown in FIGS. 3-7, the compressor remains in connection with the first drive train when the unit 100 is switched to the winching mode. When the unit 100 is used in the winching mode, the hose 150 is removed from the outlet fitting 148 and therefore any compressed gases are released to the environment through fitting 148 so that the compressor unit 104 provides little resistance on the motor 102. It should be understood that an additional clutch mechanism can also be utilized to fully disconnect the first drive train 106.

Figure 8:
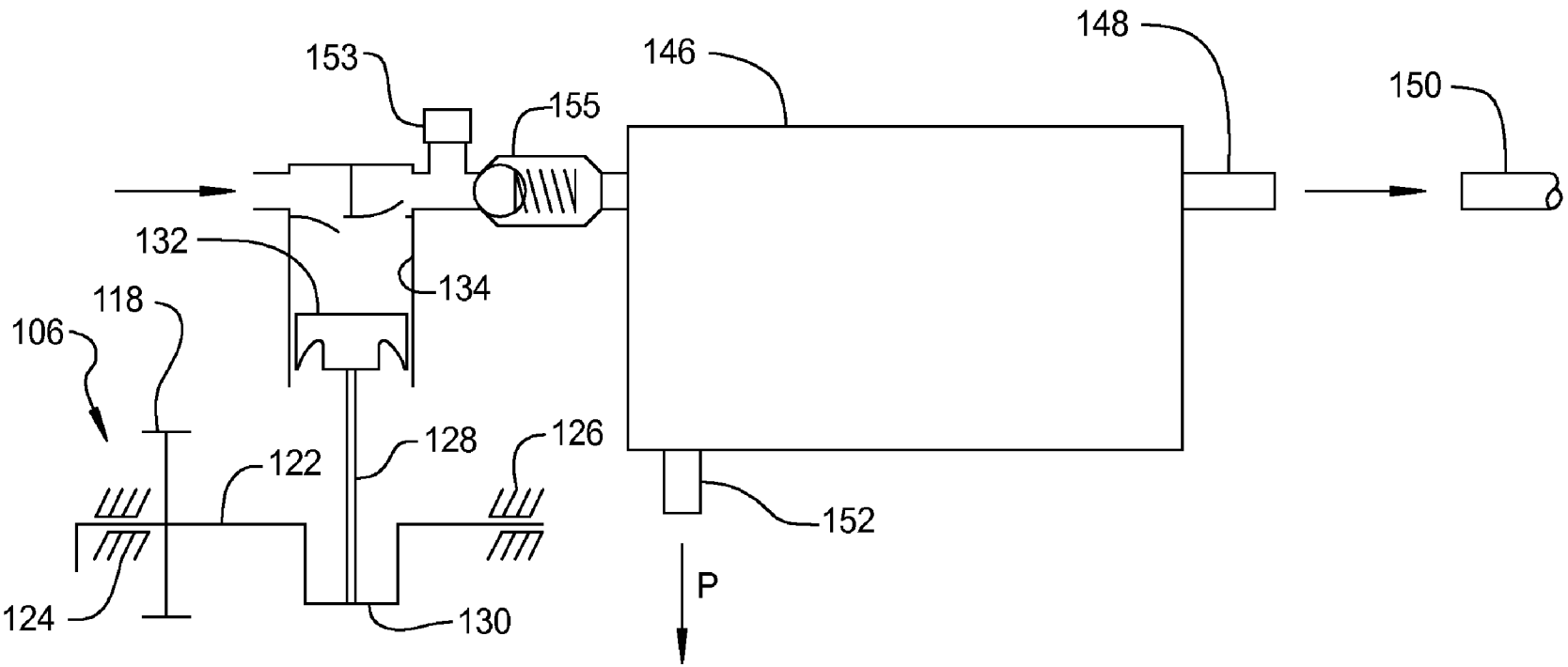
FIG. 8 is a partial schematic diagram of an alternate embodiment of the integrated air compressor and winch according to the principles of the present disclosure.

In yet an alternate embodiment as illustrated in FIG. 8, compressed gas is retained within intercooler storage vessel 146 by a flow restriction device 155, such as a check or reed valve, and outlet fitting 148, while exhaust gas from the compressor unit 104 is vented through a pressure release mechanism 153, such as a threaded vent cap. Thus, compressor unit 104 provides little resistance on the motor 102 during winching operation.

The integrated air compressor and winch 10, 100 of the present disclosure provides for enhanced functionality for both a winch mechanism and for a vehicle utilizing the integrated air compressor and winch. By the use of the term "integrated", it is meant that the air compressor and winch are compactly assembled as a unitary system. The integrated compressor and winch can be assembled to a common support structure. The integrated compressor and winch can also be housed within a common housing. According to one aspect of the present disclosure, the integrated air compressor and winch can be disposed within a package volume no larger than 33 inches wide (extending along the longitudinal length of the drum), 16 inches tall (top to bottom) and 12 inches deep (from front to back). More particularly, the package volume can be reduced to be no larger than 30 inches wide, 14 inches tall and 9 inches deep. The compact assembly of the integrated air compressor and winch allows the unitary system to be mounted to a vehicle bumper, shipped, carried or mounted to other structures as a unitary system. The use of a single source of rotary motive power for operating both the winch drum and compressor provides improved efficiency as compared to a separate winch and compressor which each would require their own motor and related power source.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a power source;

a drum mechanism driven by said power source; and an air compressor mechanism drivingly engaged with said power source;

wherein said power source, said air compressor mechanism and said drum mechanism are integrated as a unit.

2. The apparatus according to claim 1, further comprising a clutch mechanism operable for selectively providing drive torque from said power source to said drum mechanism.

3. The apparatus according to claim 2, wherein said clutch mechanism includes a shift lever for engaging and disengaging said clutch mechanism.

4. The apparatus according to claim 1, wherein said power source, said drum mechanism and said air compressor mechanism are mounted to a common support.

5. The apparatus according to claim 4, wherein said common support is adapted to be mounted to a vehicle bumper.

6. The apparatus according to claim 1, wherein said drum mechanism includes a brake system disposed within a drum of said drum mechanism.

7. The apparatus according to claim 1, wherein said power source and said air compressor mechanism are both mounted on one side of a drum of said drum mechanism.

8. The apparatus according to claim 7, wherein said power source is co-axial with said drum mechanism.

9. The apparatus according to claim 8, wherein said air compressor mechanism includes a crankshaft offset from an axis of said drum.

10. The apparatus according to claim 1, wherein said air compressor mechanism includes a storage vessel for containing pressurized air.

11. The apparatus according to claim 10, wherein said storage vessel extends between first and second drum supports which rotatably support a drum of said drum mechanism.

12. The apparatus according to claim 1, wherein said air compressor mechanism includes a piston mounted to a crankshaft.

13. An apparatus, comprising:

a power source;

a drum mechanism driven by said power source; and an air compressor mechanism drivingly engaged with said power source;

wherein said power source, said air compressor mechanism and said drum mechanism are compactly assembled as a unitary system.

14. An apparatus, comprising:

a source of rotary motive power;

an air compressor mechanism engaged with said source of rotary motive power so as to be driven by said source of rotary motive power;

a first drive train connecting said air compressor mechanism with said source of rotary motive power;

a drum selectively engageable with said first drive train by a second drive train so as to be driven by said first drive train; and a cable adapted to be wound onto and off from said drum;

wherein said source of rotary motive power, said drum mechanism and said air compressor mechanism are mounted to a common support.

15. The apparatus according to claim 14, wherein said source of rotary motive power is an electric motor.

16. The apparatus according to claim 14, wherein said second drive train includes a brake system disposed within said drum.

17. The apparatus according to claim 16, wherein said second drive train includes a gear reduction mechanism.

18. The apparatus according to claim 14, wherein said first drive train includes a drive member connected to said source of rotary motive power and a driven member connected to a crankshaft of said air compressor mechanism.

19. The apparatus according to claim 18, wherein said drive member is connected to said driven member by a belt.

20. The apparatus according to claim 14, wherein said source of rotary motive power and said air compressor mechanism are both mounted on one side of said drum.

21. The apparatus according to claim 20, wherein said source of rotary motive power is co-axial with said drum.

22. The apparatus according to claim 21, wherein said air compressor mechanism includes a crankshaft offset from an axis of said drum.

23. The apparatus according to claim 14, wherein said air compressor mechanism includes a storage vessel for containing pressurized air.

24. The apparatus according to claim 23, wherein said storage vessel includes cooling fins on an external surface.

25. The apparatus according to claim 23, wherein said storage vessel extends between first and second drum supports which rotatably support said drum.

26. The apparatus according to claim 23, further comprising a pressure release mechanism in communication with said air compressor mechanism.

27. The apparatus according to claim 23 further comprising a flow restriction device in communication with said air compressor mechanism.

28. The apparatus according to claim 14, wherein said air compressor mechanism includes an outlet fitting to which a compressor hose is releasably connected.

29. The apparatus according to claim 14, wherein said second drive train includes a clutch mechanism for engaging said first drive train.

30. The apparatus according to claim 14, wherein said air compressor mechanism includes a piston mounted to a crankshaft.

31. The apparatus according to claim 14, wherein said crankshaft is driven by said first drive train.

32. The apparatus according to claim 14, wherein said common support is adapted to be mounted to a vehicle.

33. An apparatus, comprising:

an electric motor having an output shaft;

a drum mechanism selectively engageable with said output shaft so as to be driven by said electric motor;

a cable adapted to be wound onto and off from said drum mechanism; and an air compressor mechanism drivingly engaged with said electric motor;

wherein said electric motor and said air compressor mechanism are disposed within a common housing.

34. The apparatus according to claim 33, further comprising a clutch mechanism operable for selectively providing drive torque from said electric motor to said drum mechanism.

35. The apparatus according to claim 34, wherein said clutch mechanism is disposed within said common housing.

36. The apparatus according to claim 35, wherein said clutch mechanism includes a shift lever extending from said common housing.

37. The apparatus according to claim 33, wherein said electric motor, said drum mechanism and said air compressor mechanism are mounted to a common support which is adapted to be mounted to a vehicle.

38. The apparatus according to claim 33, wherein said air compressor mechanism includes a crankshaft having an axis of rotation offset from an axis of rotation of said output shaft.

39. The apparatus according to claim 33, wherein said second drive train includes a brake system disposed within said drum.

40. The apparatus according to claim 33, wherein said electric motor and said air compressor mechanism are both mounted on one side of said drum.

41. The apparatus according to claim 40, wherein said electric motor is co-axial with said drum mechanism.

42. The apparatus according to claim 41, wherein said air compressor mechanism includes a crankshaft offset from an axis of said drum.

43. The apparatus according to claim 33, wherein said air compressor mechanism includes a storage vessel for containing pressurized air.

44. The apparatus according to claim 43, wherein said storage vessel extends between first and second drum supports which rotatably support said drum.

45. The apparatus according to claim 33, wherein said air compressor mechanism includes a piston mounted to a crankshaft.

46. An apparatus, comprising:

an electric motor having an output shaft;

a drum engageable with said output shaft, said drum having a cable adapted to be wound onto and off from said drum mechanism; and an air compressor mechanism drivingly engageable with said output shaft and including a storage vessel supported by first and second drum supports which rotatably support said drum.

47. The apparatus of claim 46, wherein said electric motor, said drum and said air compressor mechanism are mounted to a common support which is adapted to be mounted to a vehicle.

48. The apparatus according to claim 46, wherein said drum includes a brake system disposed within said drum.

49. The apparatus according to claim 46, wherein said electric motor and said air compressor mechanism are both mounted on one side of said drum.

50. The apparatus according to claim 49, wherein said electric motor is co-axial with said drum.

51. The apparatus according to claim 50, wherein said air compressor mechanism includes a crankshaft offset from an axis of said drum.

52. The apparatus according to claim 46, wherein said air compressor mechanism includes a storage vessel for containing pressurized air.

53. The apparatus according to claim 46, wherein said air compressor mechanism includes a piston mounted to a crankshaft.

54. An apparatus, comprising:

an electric motor;

a drum mechanism selectively engageable with said electric motor, said motor being disposed on a first side of said drum mechanism;

a cable adapted to be wound onto and off from said drum mechanism;

an air compressor mechanism drivingly engaged with said electric motor, said air compressor mechanism being disposed on first side of said drum mechanism;

a first drive train connecting said air compressor mechanism with said electric motor and disposed on a first side of said drum mechanism;

a second drive train connecting said drum mechanism with said first drive train, said second drive train disposed on a second side of said drum mechanism opposite to said first side and selectively engageable with said first drive train so as to be driven by first drive train.

55. The apparatus according to claim 54, wherein said electric motor, said drum mechanism are mounted on a common support.

56. The apparatus according to claim 55, wherein said support is adapted to be mounted to a vehicle.

57. The apparatus according to claim 54, wherein said second drive train includes a brake system disposed within a drum of said drum mechanism.

58. The apparatus according to claim 54, wherein said electric motor and said air compressor mechanism are both mounted on one side of said drum mechanism.

59. The apparatus according to claim 58, wherein said electric motor is co-axial with said drum mechanism.

60. The apparatus according to claim 59, wherein said air compressor mechanism includes a crankshaft offset from an axis of said drum mechanism.

61. The apparatus according to claim 54, wherein said air compressor mechanism includes a storage vessel for containing pressurized air.

62. The apparatus according to claim 61, wherein said storage vessel extends between first and second drum supports which rotatably support said drum.

63. The apparatus according to claim 54, wherein said air compressor mechanism includes a piston mounted to a crankshaft.

64. An apparatus, comprising:

a source of rotary motive power;

a drum mechanism engaged with said source of rotary motive power;

a cable adapted to be wound onto and off from said drum mechanism;

a first support member being disposed on one side of and rotatably supporting said drum mechanism; and an air compressor mechanism mounted to said first support member.

65. The apparatus according to claim 64, wherein said air compressor mechanism includes a piston mounted to a crankshaft and said crankshaft is rotatably supported at opposite ends by bearing assemblies.

66. The apparatus according to claim 65, wherein at least one of said bearing assemblies are supported by said first support member.

67. An apparatus, comprising:

an electric motor having an output shaft;

a drum mechanism selectively engageable with said output shaft so as to be driven by said electric motor;

a cable adapted to be wound onto and off from said drum mechanism; and an air compressor mechanism drivingly engaged with said electric motor;

wherein said electric motor, said air compressor mechanism and said drum mechanism are disposed within a package volume no larger than 33 inches wide, 16 inches tall and 12 inches deep.

68. The apparatus according to claim 67, wherein said electric motor and said air compressor mechanism are disposed within a common housing.

69. The apparatus according to claim 68, further comprising a clutch mechanism operable for selectively providing drive torque from said electric motor to said drum mechanism.

70. The apparatus according to claim 69, wherein said clutch mechanism is disposed within said common housing.

71. The apparatus according to claim 70, wherein said clutch mechanism includes a shift lever extending from said common housing.

72. The apparatus according to claim 67, wherein said electric motor, said drum mechanism and said air compressor mechanism are mounted to a common support which is adapted to be mounted to a vehicle.

73. The apparatus according to claim 67, wherein said package volume is no larger than 30 inches wide, 14 inches tall and 9 inches deep.

* * * * *